United States Patent [19]

Csonka et al.

[11] Patent Number: 4,800,353

[45] Date of Patent: Jan. 24, 1989

[54] MICROPOLE UNDULATOR

[75] Inventors: Paul L. Csonka, Eugene, Oreg.; Roman O. Tatchyn, Palo Alto, Calif.

[73] Assignee: The State of Oregon Acting by and through the State Board of Higher Education on Behalf of the University of Oregon, Eugene, Oreg.

[21] Appl. No.: 925,036

[22] Filed: Oct. 30, 1986

[51] Int. Cl.[4] ..... H01F 7/00

[52] U.S. Cl. ..... 335/210; 335/284

[58] Field of Search ..... 335/296, 302, 303, 306, 335/210, 284

[56] References Cited

U.S. PATENT DOCUMENTS 2,722,617 11/1955 Cluwen et al. ..... 335/284 X
3,127,544 3/1964 Blume ..... 335/284

OTHER PUBLICATIONS

Ramian et al., "Micro-Undulator Fels", Nuclear Instr. & Meth., A250:125-133 (1986).

Halbach, "Design of Permanent Multipole Magnets with Oriented Rare Earth Cobalt Material", *Nuclear Instr. & Meth.*, 169:1-10 (1980).

Ramian et al., "Micro-Undulator Fels", *Nuclear Instr. & Meth.*, A250:125-133 (1986).

Winick et al., "Wiggler Magnets at SSRL-Present Experience and Future Plans", *Nuclear Instr. & Meth.*, 172:45-53 (1980).

*Primary Examiner*—George Harris

*Attorney, Agent, or Firm*—Klarquist, Sparkman, Campbell, Leigh & Whinston

[57] ABSTRACT

Micropole undulators for use in the generation of x-rays from moving charged particles and methods for manufacturing such undulators are disclosed.

One type of micropole undulator has two jaws containing rows of spaced apart poles arranged so that each pole produces a magnetic field aligned with all other similar fields. An external biasing field extends through the jaws so that an overall undulator field of substantially sinusoidal shape and substantially zero average value extends along the undulator axis. Preferably, the poles are bars formed of a magnetizable, but unmagnetized, material so that, after the jaws are assembled, all of the bars can be magnetized simultaneously in a uniform magnetic field of suitable strength.

Another type of micropole undulator incorporates two parallel layers which have been magnetized to provide rows of alternating magnetic fields extending in opposite directions, the layers being positioned between the pole faces of a highly magnetically permeable material with the south poles of one layer opposite the north poles of the other. Poles in the layers are formed by subjecting successive regions of each layer to oppositely directed and suitably varied magnetizing forces.

35 Claims, 4 Drawing Sheets

MICROPOLE UNDULATOR

This invention was made with government support under Grants No. DE-AC03-82- ER1300 and DE-FG06-85- ER13309, awarded by the Department of Energy and Grant No. AFOSR-85-0326 awarded by the Department of Defense. The government has certain rights in this invention.

SUMMARY OF THE INVENTION

The invention relates to undulators for generating electromagnetic radiation such as x-rays by passing charged particles, most particularly high energy electrons through a series of magnetic fields which cause the particles to undulate transversely or "wiggle" as they travel along a substantially linear trajectory. In particular, the invention includes undulators for use in x-ray generating equipment suitable for medical diagnostic and research use.

Presently, undulators are used to generate electromagnetic radiation, particularly x-rays from particles travelling in linear accelerators, storage rings and other similar particle acceleration devices. Typically, such undulators comprise two series of bar magnets located on opposite sides of the path along which particles are accelerated. As particles pass between the series of bar magnets, they pass through a series of magnetic fields of alternating polarity. These fields cause the particles to be displaced transversely. As the particles are subjected to perioodically-varying transverse motion, electromagnetic radiation is released.

An undulator's internal field profiles may be designed from a specification of the desired properties of the output radiation. Conversely, for trajectories of a known character, the properties of the associated output radiation can readily be computed. In particular, radiation from sinusoidal trajectories is well understood and has been extensively treated and/or tabulated by several authors, including Krinsky et al. in *Handbook on Synchrotron Radiation,* ed. E. E. Koch (Amsterdam, 1983). In consequence of this, undulators that induce sinusoidal trajectories, particularly those restricted to a plane, are in predominant use today. It is easy to deduce, from the Lorentz force acting on a relativistic charged particle moving along an undulator axis, that to achieve such a trajectory, a unidirectional field of sinusoidally varying amplitude must be set up perpendicular to the undulator's midplane. Most undulator construction techniques, including ours, are therefore directed toward approximating this requirement. The techniques described herein are, however, just as amenable to producing fields of more general periodic or non-periodic distribution if so desired.

At present, magnetic-field undulators employ electromagnets, permanent magnets, and soft steel in various combinations. Common to most of these designs is the segmentation of the elements used to provide the field variations within the individual periods. In one design, described by K. Halbach in *Journal of Applied Physics,* 57, 8, IIA, 3605 (1985), four individual permanent magnets are placed serially in both the top and bottom "jaws" bordering one period of the device, with their fields rotated successively by 90°. Along the midplane between the jaws, this produces one period of an approximately sinusoidal magnetic field. Due to the requirement of several individual magnets within one period, combined with the difficulty of cutting such pieces to small and precise dimensions out of presently available permanent magnet materials, which tend to be hard to machine and/or brittle, it appears that techniques such as these cannot readily be used to construct undulators with periods shorter than about three millimeters or so.

It is thus a problem with existing undulators that, to achieve a useful high degree of monochromatization, one needs a large number of undulations. To obtain the needed number of undulations, existing devices are rather long. It is also a problem that, to obtain higher energy x-rays, small magnetic poles are needed.

To provide highly monochromatized x-rays or high energy x-rays, in a laboratory such as that of a medical center or university, which would have only relatively low energy electrons available to it, one would need an undulator with very closely spaced poles.

The availability of micropole undulators, i.e., undulators with submillimeter periods and high midplane fields, would profoundly affect the development of x-ray sources. For example, with such devices, x-ray beams comparable to those from conventional undulators would be attainable on storage rings of much lower energy than those presently in use. The next generation of electron storage rings is expected to have emittances of the order of $10^{-9}$, $10^{-10}$ rad-m and beam diameters of less than about 1O $\mu$m. Micropole undulators would clearly be appropriate for use in such machines. If a 2000 pole micropole undulator could be less than 1 cm long, a significant reduction in beam radius would be possible. If the micropole undulator were located in a bypass within a distance $\lambda_w$ from the beam axis, its full effect could be obtained, though not in each turn, without seriously reducing the beam lifetime.

X-ray instrumentation would also be affected, e.g. micropole undulators of sufficient length would provide extremely monochromatic outputs, obviating the need for expensive and complex ultra-high vacuum monochromator systems.

Compared to conventional undulators, the period of a micropole undulator would be shorter by a factor f. Since the typical period of conventional undulators is $>2$ cm, one has $f>20$. Therefore, micropole undulators would make it possible to achieve several important technological goals, including the following:

1. For a charged particle beam of given energy, $E_e$, passing through undulators of a given length, the radiated photon energy, $E\gamma$, would be increased by the same factor f for the micropole undulator.

2. If photons of a given energy $E\gamma$ are desired, those could be generated by a charged particle beam whose energy $E_e$ is less by a factor $f^{\frac{1}{2}}$.

3. If the charged particles move in a circular machine, then such a reduction in their energy implies that radiative energy losses would be diminished by a factor $f^2$, provided that the radius of the orbit is left unchanged.

4. Alternatively, keeping the radiative energy losses fixed, a reduction of $E_e$ by the factor $f^{\frac{1}{2}}$ would allow reducing the orbit radius by f. That, in turn, implies a corresponding reduction of circular machine construction costs by $f^{\alpha}$, where $\alpha>1$. For linear machines, reduced $E_e$ similarly implies reduced length and cost.

5. For undulatoprs of a fixed length, the spectral purity of the emitted undulator photons would increase by a factor f. For example, for an undulator period of $2\times10^{-2}$ cm ($f>100$), a two meter long micropole undulator would generate radiation with a resolution of $\lambda/\Delta\lambda=10^4$ for each emitted harmonic photon wavelength λ. This could reduce, or even obviate, the need for the complex and costly monochromator systems in present use.

Smaller and less costly machines, and/or lower radiative energy losses, would make x-ray sources more easily accessible to educational and medical agencies, and to users interested in utilizing energetic photons for various scientific and industrial purposes. New experimental possibilities would also be opened up by the availability of such devices; some of these have been reviewed in a recent publication by P. Csonka. *SPIE Proceedings*, No. 582 (1986), page 298 et seq.

But, heretofore there has been no practical technique for constructing.

The technique for making traditional undulators is to mount the series of varyingly magnetized bars on a supporting substrate, typically using some form of adhesive. However, there is no practical way to mount submillimeter bars, or more correctly "fibers", of magnetized material using such a technique. The spacing of the magnetized bars is critical, but there is no practical way to hold submillimeter bars in close proximity to one another while the adhesive is being set. An adjacent pole, less than a millimeter away, will attract or repel the magnetized fiber being laid down. Even orienting such small bars, so that their poles are in proper alignment, leads to great difficulties. Moreover, appropriate magnetizable materials tend to be brittle and easily broken if small in size, particularly if subjected to the magnetic field of an adjacent magnetized bar.

An additional problem that makes it difficult to scale down conventional configurations to small sizes is the inherently high coercive tension (i.e. tendency of the poles to mutually demagnetize themselves) among contiguous pieces of high aspect ratio whose magnetization vectors point in different directions. The effects of coercive tension tend to increase as the size (i.e. height to width ratio) is decreased, they can become very large when the linear dimensions of the individual magnetized regions become very small.

Methods have now been discovered to construct undulators with genuinely small submillimeter periods, without having to deal with the difficulties of mounting magnetized fibers or utilizing configurations of high coercive tension.

In a first method, "bias field" micropole undulators can be constructed by (a) providing two "jaws" facing each other, each jaw containing a row of spaced apart poles or magnetized bars aligned so that each produces a magnetic field aligned with all others and (b) introducing an external "bias" field to achieve an overall undulator field of substantially zero average value along the undulator axis. By this method, an approximately sinusoidal field is obtained within each period with only one salient pole in each jaw. The peak field amplitude (for an average field of 0 along the axis) is about half the value of the remanent field. The poles can be formed by providing, on both jaws, a series of bars made of magnetizable (but as yet unmagnetized) material, in which the crystal axes are essentially all aligned with each other so as to allow magnetization in a common, desired direction, preferably perpendicular to the axis of the undulator. All the bars can then be magnetized simultaneously by placing the jaws in a substantially uniform magnetic field. In this first method, fields of more general, non-sinusoidal profile may also be established within any period of the device, or a general nonperiodic field established, by (a) varying the width of the pole faces, (b) placing permanent magnet blocks of different remanent field strengths serially, or (c) contouring the pole faces of the permanent magnet blocks.

In a second method, a micropole undulator can be constructed by periodical transverse magnetization of thin magnetizable layers and subsequent installation of these layers between the poles of a yoke made of a magnetizable material such as iron or soft steel. Two such layers facing each other will generate a generally sinusoidal undulator field in the space between the layers. Configuration stability is obtained by securing each layer to an appropriate solid substratum which could be the corresponding pole face of the yoke or some intermediate layer of material.

The second method allows great flexibility, while the first method provides very accurate periodicity, particularly when the poles are formed by etching in a holographically generated pattern. Furthermore, although the contiguous magnetized regions in the second method may be magnetized in opposite directions, the fact that the regions are of very low aspect ratio, and that they are imbedded between the pole faces of a highly permeable yoke, reduces the tendency of these regions to demagnetize themselves to the point where the peak-to-peak field amplitude can approach twice the remanent field of the magnetizable material comprising the micropole undulator jaws. As is the case for the first method, the second method can also be used to establish general field profiles (not just approximately sinusoidal) within any period, or can also establish general non-periodic profiles as well.

Short period static micropole undulators according to the present invention should be particularly well suited for dressed ion beam cooling.

Accordingly, it is an object of the present invention to provide undulators with very short periods.

A further object is to provide well controlled magnetic fields in short period undulators.

It is also an object to provide techniques for manufacturing undulators with poles less than 1 mm in width and spaced less than 1 mm apart.

These and other objects and advantages of the present invention will become apparent from reading the following detailed description with reference to the accompanying drawings.

DETAILED DESCRIPTION

A "micropole undulator", as discussed herein, is defined as an undulator having a period of less than one millimeter and correspondingly short poles. Considerably shorter periods, on the order of $10^{-4}$ cm, can be achieved by the methods of this invention.

A "magnetically soft material" is a material that is easily demagnetized after the magnetizing field is removed. Such a material can be demagnetized with a minimal coercive force.

A "magnetically hard material" is a material that strongly retains appreciable magnetization when a magnetizing field is removed.

A material with "low magnetic remanence" is a material with little or no residual magnetization when a magnetizing force is removed.

A material with "large relative magnetic permeability" is a material that attracts and channels magnetic fields.

Micropole undulators of the present invention can be manufactured by a variety of techniques. Two particular undulator designs are employed.

A. Bias Field Micropole Undulators

A first micropole undulator according to the present invention is a device of a novel bias design. An example is shown schematically in FIG. 1.

The illustrated micropole undulator includes first and second opposed jaws 20, 22 spaced equidistant from an undulator axis 30 which substantially coincides with the trajectory of moving charged particles. A magnetic yoke 32 is located outwardly of the jaws to provide a magnetic field, referred to herein as the bias field.

Figure 2A:
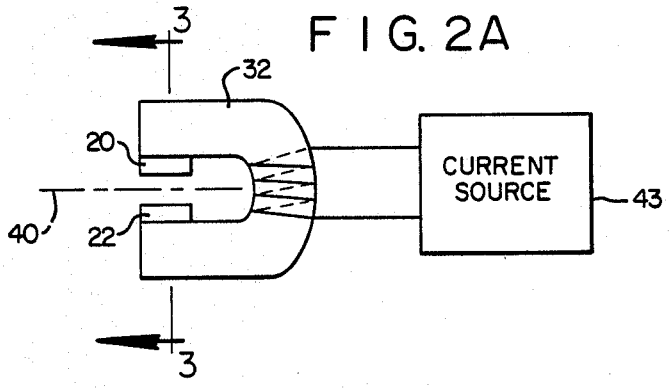
FIG. 2A is a schematic side elevation of the undulator shown in FIG. 1 with an electromagnetic biasing yoke.
Figure 2B:
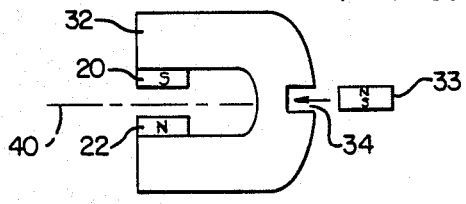
FIG. 2B is a schematic side elevation of the undulator shown in FIG. 1 with a permanent magnet biasing yoke.

The yoke 32 can comprise an electromagnet as shown in FIG. 2A or employ a permanent magnet. FIG. 2B illustrates an embodiment wherein a permanent magnet 33 is introduced into a suitable slot or gap 34 in a yoke at such times as it is desired to apply the bias field. For the illustrated embodiments, the yoke preferably is made of a material that has a low magnetic remanence such as soft steel or iron.

The yoke is best positioned such that it equally distributes the bias field over the jaw surfaces and isolates the jaws from other magnetic structures which may be in the vicinity. As illustrated, the yoke 32 should be of greater dimensions than the jaws 20, 22 so that the jaws are located entirely within that region of the field of the yoke wherein the field is substantially uniform. A gap can be provided between the jaws 20, 22 and the yoke 32; but more conveniently, the jaws will be mounted in contact with the yoke.

Figure 3:
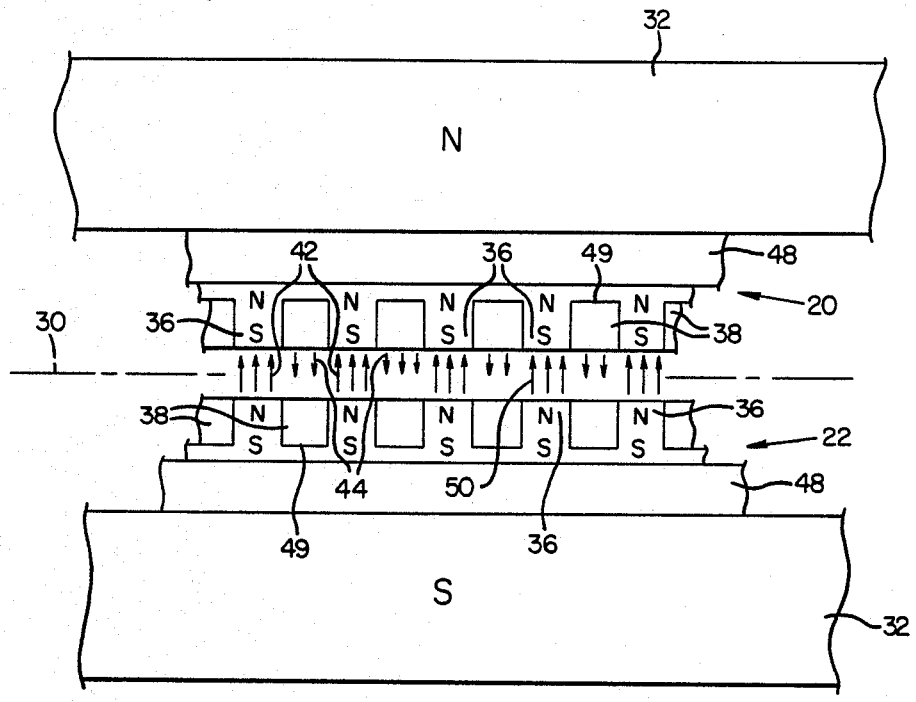
FIG. 3 is an enlarged, partial, sectional view of a first embodiment of the undulator shown in FIG. 1, the view being taken along line 3—3 of FIG. 1.

FIG. 3 shows internal detail of a first embodiment of the bias field design. In this embodiment, the jaws 20, 22 comprise a plurality of magnetic bars or poles 36 supported on a solid substrate 48 to increase configuration stability. The bars 36 are formed of a magnetizable material having a high magnetic remanence and preferably also a high coercive force. The most suitable of known materials are neodymium-iron-boron materials (referred to herein as NdFe/B) and rare earth cobalt materials, particularly samarium-cobalt materials such as $SmCo_5$ and $Sm_5Co_{17}$ (referred to herein as SmCo).

The substrate 48 may be constructed of any material which can be provided with a sufficiently smooth and, precisely dimensioned surface. The material should be heat conducting and have a large relative magnetic permeability and a low magnetic remanence. Metals are preferred, but materials such as ceramics and plastics may be used if they have the desired properties. In some embodiments, no substrate 48 would be required. For example, poles 36 could be formed from magnetizable material deposited directly on the surface of the yoke 32.

The bars are separated by spaces 38, the bars and spaces of each jaw both extend transversely to the axis 30 in a plane parallel to the midplane 40 of the jaws. In the illustrated embodiment, the bars 36 of each jaw extend parallel to each other and extend at a 90° angle with respect to the axis when viewed from the top or bottom. While such an arrangement is preferred, the bars could extend at an angle other than 90° and need not be parallel to each other, so long as they produce a suitable pattern of fields. Each of the bars of the first jaw 20 has a south pole which faces the midplane 40 and each of the bars of the second jaw 22 has a north pole which faces the midplane so that there are a plurality of primary magnetic fields 42 extending across the midplane. Each primary field 42 extends between opposed bars of the two jaws respectively.

The yoke 32 provides a uniform magnetic field in a direction opposite that of the primary fields 42. The field provided by the yoke reduces the strength of the primary fields 42 and has the effect of producing a plurality of secondary magnetic fields 44 extending across the axis 30 between opposed spaces 38 of the two jaws respectively as shown in FIG. 3. The field strength of the yoke 32 is selected such that the secondary fields 44 have substantially half the strength as the primary fields and are oppositely directed. Because the strength of the primary fields is reduced by half due to the presence of the bias field, there is a generally sinusoidal undulator field of substantially zero average value along the undulator axis. To assist in achieving this result, the width of the faces of the poles 36 will preferably, but not necessarily, be equal to the width of the spaces 38.

The static magnetic field in a micropole undulator falls off with distance d measured from the magnets, as $\exp(-d/\lambda_w)$ for large d. Therefore, for micropole undulators the field is significant, if d is less than about $\lambda_w$. The gap between opposed bars 36 on opposite jaws should be no greater than the distance between the adjacent bars on the same jaw.

The undulator is positioned in relation to a beam of charged particles such that the axis 30 coincides substantially with the trajectory of the beam. An undulator so positioned will have substantially no effect on the general trajectory of the beam outside the undulator. But, if necessary, compensating permanent magnets or electromagnets can be positioned immediately upstream and/or downstream of the undulator to correct for any beam deflection caused by the undulator.

In general, jaws 20, 22 for the micropole undulator of FIG. 3 are constructed using originally unmagnetized material, whose crystal structure allows magnetization.

As a first step in making the embodiment of FIG. 3, the material is mechanically applied in a very thin layer, on a substrate. The layer may be applied by vapor deposition, electrolytic deposition, sputtering, or some similar technique. The magnetizable material could also be glued or soldered to the substrate using a suitable adhesive resin or low temperature solder.

Figure 4:
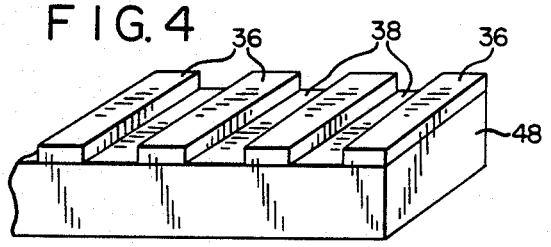
FIGS. 4 and 5 isometric schematic views of a portion of a jaw that is similar to the jaws shown in FIG. 3 during two stages of its construction.

A regularly placed sequence of parallel spaces or grooves 38 is then removed from the magnetizable material to provide the structure shown in FIG. 4. The technique used for forming the spaces 38 must be capable of forming such spaces with widths less than one millimeter. In the particular embodiment of FIGS. 4–5, lithographic techniques have been used to form the spaces 38 by etching out regularly placed grooves in the magnetizable material. The spaces could likewise be formed by depositing the magnetizable material with masks, by etching a layer with chemicals, molecular beam or ion beam, by sand blasting, laser cutting, electrical discharge machining, or by some other similar technique. The spaces 38 of the FIG. 3 embodiment are formed by machining grooves only partially through the magnetizable material such that a thin layer 49 of magnetizable material extends along the substrate between the bars 36.

Figure 5:
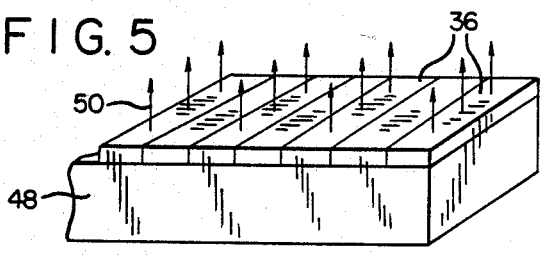

It can be beneficial to fill in the grooves 38, as shown in FIG. 5, with a supporting, bias pole material, such as epoxy resin. Other suitable materials include iron and steel. The supporting material preferably has a low magnetic remanence, high strength, and a coefficient of heat expansion close to that of the bars 36.

The bars 36 are placed in a strong, uniform magnetic field and thereby are magnetized. The bars of each jaw could be magnetized separately. Alternatively, the jaws 20, 22 will first be mounted in opposition to form a unit whereafter all the bars 36 of both jaws are magnetized simultaneously. The bars 36 are magnetized so as to provide perpendicular fields, as indicated by arrows 50 which represent magnetic field lines. The result will be an overall magnetic field whose value varies periodically along the axis 30, but whose direction is essentially unchanged. This, by itself, is not suitable as an undulator field. A suitable undulator field is produced when a constant, uniform background magnetic field is applied in the opposite direction by the yoke 32.

Figure 6:
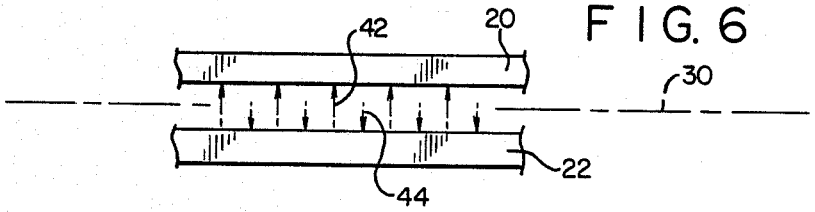
FIG. 6 is a schematic diagram of the undulator field of the undulator shown in FIG. 3.

To a certain extent, the background field from the yoke 32 will subract from the fields provided by the bars 36. The net effect, as shown in FIG. 6, will be a pattern of alternating, opposed fields. The strength of the bias or background field should be adjusted so that the strengths of the primary fields 42 provided by the bars 36 minus the bias field are substantially equal to the strengths of the secondary fields 44 which are provided solely by the bias field.

Figure 1:
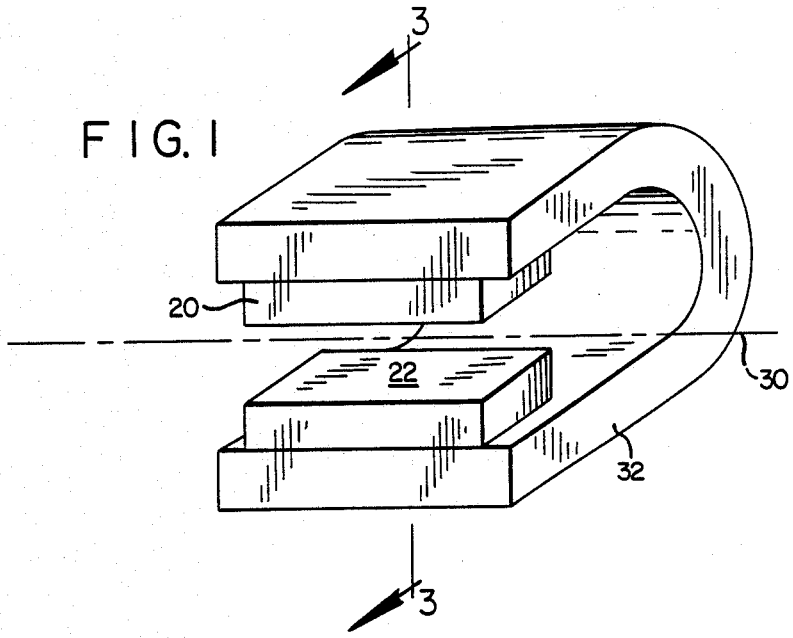
FIG. 1 is an isometric, schematic view of a bias field micropole undulator according to the present invention.

A thirty-five period, one cm wide micropole undulator, whose total length is one inch (2.54 cm), has been constructed according to the design of FIGS. 1–3. All poles 36 were made of NdFe/B, which can achieve remanent fields as high as 1.2 Tesla. The NdFe/B is secured to a 1/16 inch thick copper substrate 48 using epoxy resin. The bars 36 are 400$\mu$ wide and the spaces 38 are 326$\mu$ wide to provide a micropole undulator with a period of 726$\mu$ long. The gap between the jaws 20, 22 is 0.25 mm.

A substantially uniform bias field is provided by a yoke 32 made of steel. The yoke 32 is an electromagnet as shown in FIG. 2A. The magnetization of the steel yoke 32 is induced when an electric current source 43 is activated.

Due to the shortness of the periods, measurements of the fields in the prototype micropole undulator had to be done with a specially designed probe. The basic approach was to measure the voltage V induced across a thin wire, forty microns in diameter, perpendicularly aligned to the main axis 30 of the micropole undulator, and moving at a constant velocity v in the midplane 40 of the device. The governing equation is:

$$V(\text{Volts}) = v(\text{meters/sec})\ l(\text{meters})\ B(\text{Tesla}) \quad (1)$$

where l is the length of the wire exposed to the field (about 0.01 meter in the tested device), and B is the average field between the poles along the direction of the wire. It should be evident that the actual field along the center of the micropole undulator is somewhat higher than the average value recorded via Equation (1).

The voltage V was read directly with an oscilloscope, and the field profiles were photographed for various gaps down to 250 microns. The velocity of the wire could be read off directly from an oscilloscope scan at 250 microns by taking the length of the sweep within the micropole undulator to be 0.0254 meters. In this fashion, it was verified that a peak-to-peak field of more than 6 kilogauss was actually attained. Field simulations show that smaller gaps would have generated even higher peak fields. Because the faces of the poles 36 within each period are somewhat wider than the spaces 38, the midplane field deviated slightly from an ideal sinusoidal shape.

Figure 7:
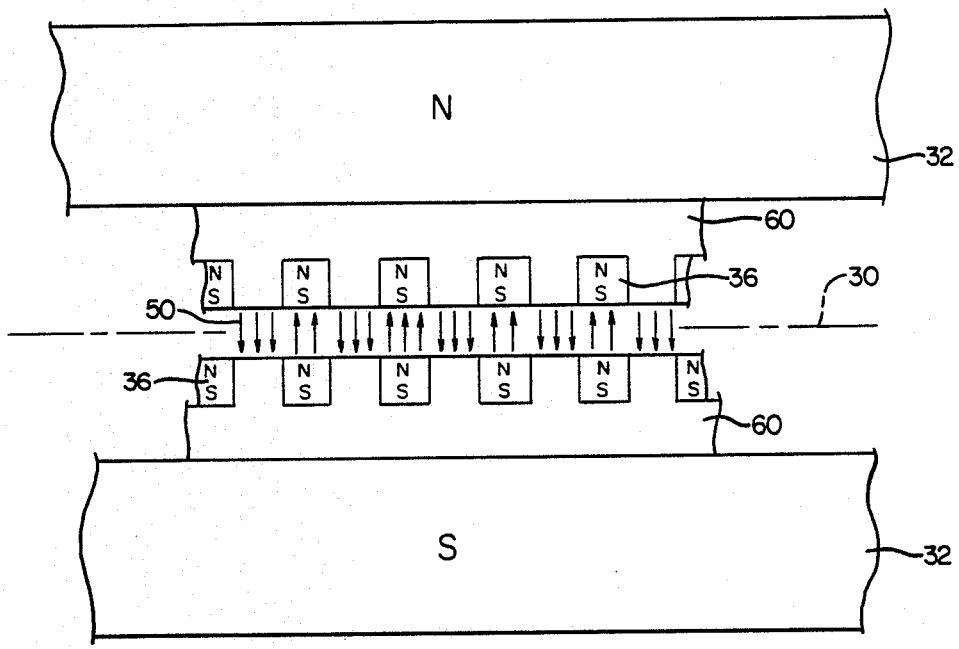
FIG. 7 is an enlarged, partial, sectional view of a second embodiment of the undulator shown in FIG. 1, the view being taken along line 3—3 of FIG. 1.

An alternate embodiment of the invention is shown in FIG. 7. In this embodiment, the bars 36 are completely surrounded by a supporting material 60 of the type used in the embodiments of FIGS. 3 and 5. The supporting material 60 should have a large relative magnetic permeability and low magnetic remanence. Operation of the micropole undulator of FIG. 7 is similar to that previously described, except that the bias field generated by the yoke 32 will reach the undulator axis 30 concentrated predominantly through the spaces between the bars 36.

Figure 8:
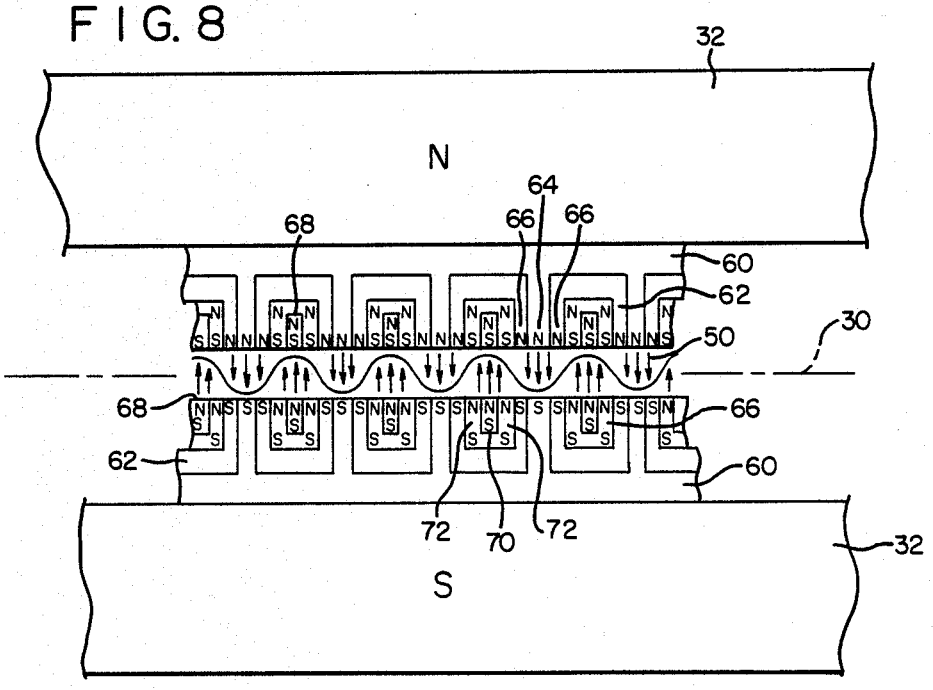
FIG. 8 is an enlarged, partial, sectional view of a third embodiment of the undulator shown in FIG. 1, the view being taken along line 3—3 of FIG. 1.

FIG. 8 shows yet another embodiment. The undulator of FIG. 8 also includes poles surrounded by a body of supporting material 60. However, this undulator provides, in the spaces between the poles, more than one type of supporting material. In addition to the supporting material 60, there is an inner layer of a second supporting material 62. The two supporting materials 60, 62 have different physical properties such that, within a given space between two adjoining bars, the magnetic flux density is greater at the center than at regions near the adjoining bars. This can be accomplished by using two supporting materials having different relative permeabilities, the magnetic permeability of the first supporting material 60 being greater than the permeability of the second supporting material 62. With such an arrangement, when a uniform magnetic field is applied by the yoke 32, the transmitted field will be stronger at the center 64 of the space between two adjacent bars 36, i.e. at the center of each bias pole, than at the sides 66.

Similarly, the poles or bars 36 can be made of multiple materials to provide a varying field strength along the axis 30. In particular, each pole can be made from an outer layer of magnetizable material 66 and an inner core of magnetizable material 68. Both materials should have a high magnetic remanence and preferably also a high coercive force. So that all portions of all the bars 36 can be magnetized at once, the magnetizable material 68 should have a greater remanance than the outer layer of magnetizable material 66 which is near the adjoining spaces. After the bars have been submitted to a uniform magnetizing field, the inner core of magnetizable material 68 will have a greater field strength along the axis 30 than the outer layer of magnetizable material 66. In other words, the field strength at the center 70 of the bar will be greater along the axis 30 than the field strengths at the regions 72 that are alongside the adjoining spaces 38, which spaces contain biasing poles material 60, 62.

The apparatus of FIG. 8 is advantageous because, as a result of varying pole strength along the axis, a more nearly accurate sinusoidal net field can be achieved. The greater the number of materials used, the more accurate a curve can be reproduced.

A method for constructing jaws of the type shown in FIGS. 7 and 8 is illustrated in FIGS. 9–13. The jaws are constructed on a manufacturing substrate 76 which provides a flat upper surface 77. Optionally, one or more thin intermediate substrate layers 78 may be provided on top of the surface 77.

Figure 9:
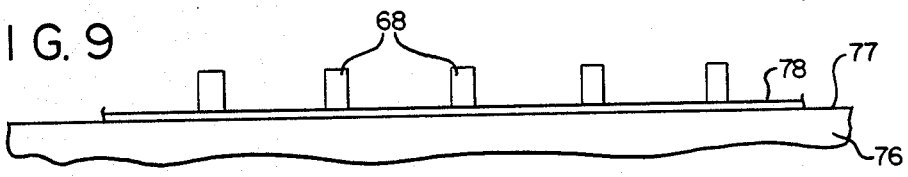
FIGS. 9–13 are partial sectional views of a portion of a jaw shown in FIG. 8 during five stages of its construction.
Figure 10:
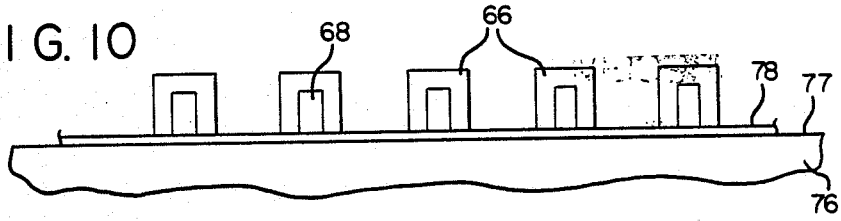
Figure 11:
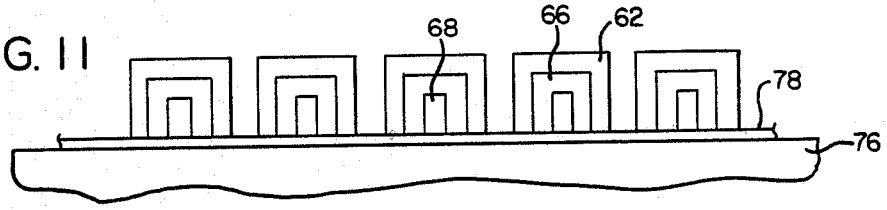
Figure 12:
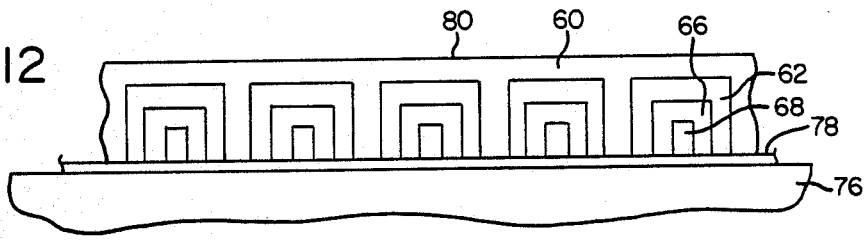

Layers of the various materials used to make up the poles are successively deposited in desired patterns, preferably by the use of masks. To make a jaw as shown in FIG. 8, first the inner core of magnetic material 68 is deposited for each bar on the substrate 77 as shown in FIG. 9. FIG. 10 shows a subsequent deposit of the outer layer of each bar over the core 8. Next, a layer of the second supporting material 62 is deposited as shown in FIG. 11. Then, as shown in FIG. 12, the first low magnetic remanence supporting material 60 is deposited over the entire assembly to provide a jaw of uniform width along its entire length. If necessary, the surface 80 can be milled to be substantially planar.

Figure 13:
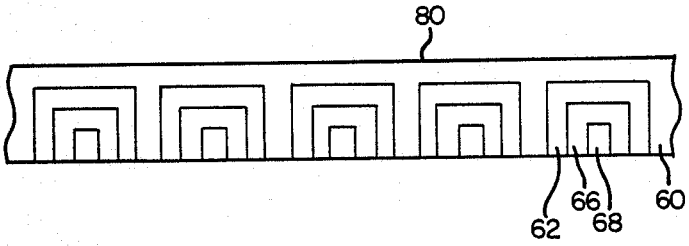

Next, the manufacturing substrate 76 is removed, along with the substrate layer 78, if any. The substrate layer 78 is used if the deposit materials would otherwise adhere to the manufacturing substrate 76. If the materials adhere to the substrate 78, the substrate 78 can be removed by a solvent which does not affect the materials 60–68, or it could be physically removed, e.g. by sandblasting, milling or the like. The remaining construction, shown in FIG. 13, is ready to serve as a jaw in a bias field type micropole undulator.

There are other possible ways of enhancing the shape of the field curve of a micropole undulator. Individual magnetizable and supporting materials could be selected or formed such that they have differing field characteristics along an axis 30. If particular care were taken in the magnetizing process, the bars 36 could be magnetized more intensely in the center than the regions near the spaces 38. Similarly, rather than using an overall uniform bias field, the biasing yoke 32 might be constructed to provide field intensities that differ along the axis 30 so that there was a stronger net field at the center of the spaces 38 than at the regions of those spaces near the adjacent bars 36.

B. Thin Layer Micropole Undulators

Figure 14:
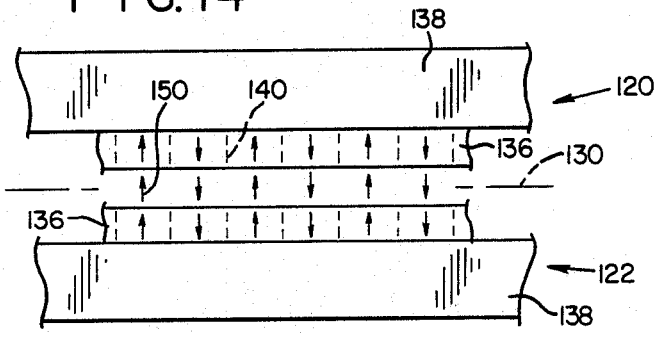
FIG. 14 is a partial front elevation of a thin layer micropole undulator according to the present invention.

FIG. 14 illustrates schematically a thin layer micropole undulator according to the present invention. This apparatus includes two bodies or jaws 120, 122 spaced equally from a micropole undulator axis 130. In operation, the axis 130 is positioned to coincide substantially with the trajectory of a moving charged particle. Each jaw has a substantially planar layer 136 of magnetizable material (which is permanently magnetized before use). The magnetizable material can be any suitable, magnetically hard material that has a high residual magnetization and requires a large coercive force for demagnetization. Particularly suitable materials include NdFe/B and SmCo. The layers 136 must be supported, for dimensional stability and diminution of coercive tension, on magnetizable substrate members 138.

In the embodiment of FIG. 14, alternating regions of each layer 136 are magnetized to provide oppositely directed magnetic fields. The field lines are represented by arrows 150. The boundaries of the regions are illustrated by broken lines 140. The north and south poles of the first jaw 120 are respectively positioned directly opposite the south and north poles of the second jaw 122.

Figure 15:
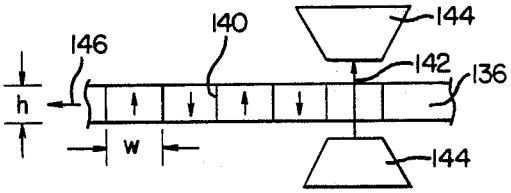
FIG. 15 is a front elevational view of a magnetizable layer shown in FIG. 14 during its magnetization.

As illustrated in FIG. 15, each layer 136 can be magnetized by subjecting alternating regions of the layer to a transverse, but not necessarily perpendicular magnetizing field of sufficient strength to permanently magnetize the region that coincides with the field. In FIG. 15, the field line appears as arrow 142. Reversed magnetizing fields are applied so that adjacent regions of the layer are magnetized to produce fields, of opposite polarity, that are transverse and can be perpendicular to the layer. The layers 136 are to be thick enough to retain the inherent coercive force of the bulk material, but the aspect ratio of the magnetized regions (h/w) should be small enough so that most of the material over the extent w is not exposed to any appreciable part of the internal fields of the regions contiguous to it. Suitable aspect ratios are between about 0.1 and 1.

A layer of any desired length can be inscribed by aligning a region of the layer with an electromagnetic head 144 and then activating the head so that the field, illustrated by arrow 142, extends through the layer. Next, the layer 136 is moved in relation to the head 144, as illustrated by the arrow 146, so that the head is aligned with the next adjacent region of the layer. A reverse field is then applied through the layer to magnetize the region then adjacent the head 144. Next the layer is again moved in the direction of arrow 146 to the next adjacent region, the polarity of the magnetizing field is reversed and the process is repeated as many times as necessary to provide jaws for an undulator of a desired number of periods. During recording, the layer 136 is moved along a substantially straight line so that the magnetized regions can be aligned with the axis 130.

An alternative related method consists of including intermediate regions magnetized to an intermediate degree, or of continuously varying the magnetization field applied to a continuously moving layer 136, so that a more nearly accurate sinusoidal field curve is achieved.

Most conveniently, the recording head 144 is an electromagnetic device which is activated by applying electric current of a desired polarity. In particular, transverse magnetization with period $\lambda_w$ can be achieved by inscribing with an electromagnetic head whose relevant dimension is $<\frac{1}{2}\lambda_w$. The magnetic field generated by the heads can be controlled by appropriate software allowing great flexibility in choosing and varying $\lambda_w$. In this way, a layer of any desired length can be inscribed and fields of arbitrary profile within any period, or non-periodic fields, can be imprinted.

The layer 136 can be applied to the substrate 138 before magnetizing. In such a case, the substrate 138 will preferably be a material which has a large relative magnetic permeability, but which has a low magnetic remanence, so that the magnetizing field generated by the head 144 is not substantially interfered with by the substrate material during magnetization and is not retained by the substrate. A ferromagnetic material, such as iron or soft steel, is particularly well suited for such a substrate 138. A thin layer of polymer sheeting such as the polyester film described in U.S. Pat. No. 2,823,421 could be placed between the layer 136 and the highly permeable substrate 138.

Having illustrated and described the principles of our invention with reference to preferred embodiments, it should be apparent to those persons skilled in the art that such invention may be modified in arrangement and detail without departing from such principles. We claim as our invention all such modifications as come within the true spirit and scope of the following claims.

We claim:

1. An undulator for causing transverse undulations in the trajectory of a charged particle travelling along in a substantially linear trajectory, the undulator comprising:

first and second opposed jaws located on opposite sides of an undulator axis which is positionable substantially to coincide with the trajectory of moving charged particles, each jaw comprising a plurality of magnetic bars which are separated by spaces and which extend transversely to the axis, each of the bars of the first jaw having a south pole which extends toward the axis and each of the bars of the second jaw having a north pole which extends toward the axis so that a plurality of primary magnetic fields extend across the axis, each primary field extending between opposed bars of the two jaws respectively; and a magnetic biasing means for providing a biasing magnetic field extending across the axis in a direction substantially opposite that of the primary fields, such that the strengths of the primary fields are reduced and the net effect is to provide a plurality of secondary fields extending between opposed spaces of the two jaws in a direction substantially opposite that of the primary fields.

2. The undulator of claim 1 wherein the field strength of the biasing field is selected such that there is an undulator field of substantially zero average value along the undulator axis.

3. The undulator of claim 1 wherein the bars are made of a substance selected from the group consisting of NdFe/B and SmCo.

4. The undulator of claim 1 wherein the biasing means comprises a magnetized yoke.

5. The undulator of claim 4 wherein:

the yoke is made of a material that has a low magnetic remanence; and magnetization of the yoke is induced with an electric current or by subjecting the yoke to the field of a permanent magnet.

6. The undulator of claim 4 wherein the yoke is made of a ferromagnetic material selected from the group consisting of iron and steel.

7. The undulator of claim 4 wherein the yoke comprises a permanent magnet.

8. The undulator of claim 1 adapted to provide, within a given space, a magnetic flux density that is greater at the center of the space than at regions near the adjoining bars.

9. The undulator of claim 1 wherein at least one of the bars comprises a body of magnetizable material that has a greater magnetic remanence at the center of the bar than at regions near the adjoining spaces.

10. The undulator of claim 1 wherein each jaw further comprises a substrate which supports the bars.

11. The undulator of claim 10 wherein there is a thin layer of magnetizable material extending along the substrate between the bars.

12. The undulator of claim 10 wherein there is no magnetizable material extending between the bars.

13. The undulator of claim 10 wherein the substrate comprises a material that has a low magnetic remanence .

14. The undulator of claim 1 wherein the spaces between the bars of each jaw are filled with a bias pole material that has a large relative magnetic permeability.

15. The undulator of claim 14 wherein at least one of the spaces is filled with a bias pole material that has a greater relative magnetic permeability at the center of the space than at regions near the adjoining bars.

16. The undulator of claim 14 wherein the bias pole material has a low magnetic remanence.

17. A method for causing transverse undulations in the trajectory of a charged particle travelling along a substantially linear trajectory, the method comprising:

providing a pair of parallel jaws between which extends an undulator axis positioned to coincide substantially with the trajectory of moving charged particles, each jaw comprising a plurality of permanently magnetized bars, the bars being separated by spaces, each bar being aligned transversely to the axis so that each bar produces a primary magnetic field substantially parallel to all others; and providing a biasing magnetic field extending across the axis in a direction substantially opposite to the primary fields produced by the bars such that the strengths of the primary fields are reduced and the net effect is to provide a plurality of secondary fields extending between opposed spaces of the two jaws in a direction substantially opposite that of the primary fields.

18. A method for providing an undulator to cause transverse undulations in the trajectory of a charged particle travelling along a substantially linear trajectory, the method comprising:

providing a pair of parallel jaws between which extends an undulator axis positionable to substantially coincide with the trajectory of moving charged particles, each jaw comprising a plurality of bars of magnetizable material, the bars being separated by spaces, each bar being aligned transversely to the axis;

permanently magnetizing the bars simultaneously by placing the pair of jaws in a substantially uniform magnetic field so that, after magnetization, each bar produces a primary magnetic field substantially parallel to all others; and providing a biasing magnetic field extending across the axis in a direction substantially opposite to the primary fields produced by the bars, such that the strengths of the primary fields are reduced and the net effect is to provide a plurality of secondary fields extending between opposed spaces of the two jaws in a direction substantially opposite that of the primary fields.

19. The method of claim 18 wherein the field strength of the biasing field is selected such that there is an undulator field of substantially zero average value along the undulator axis.

20. The method of claim 18 wherein the magnetizable material is selected from the group consisting of NdFe/B and SmCo.

21. The method of claim 18 wherein the bars are formed by:

applying a layer of magnetizable material to a substrate; and etching out regularly spaced parallel grooves from the magnetizable material.

22. The method of claim 18 wherein the bias field is provided by placing the pair of jaws within a magnetized yoke.

23. The method of claim 22 wherein:

the yoke comprises a material that has a low magnetic remanence; and the magnetization of the yoke is induced with an electric current or by subjecting the yoke to the field of a permanent magnet.

24. The method of claim 22 wherein the yoke comprises a permanent magnet.

25. An undulator for causing transverse undulations in the trajectory of a charged particle travelling along a substantially linear trajectory, the undulator comprising:

first and second opposed jaws located on opposite sides of an undulator axis which is positionable substantially to coincide with the trajectory of moving charged particles, each jaw comprising a substantially planar layer of magnetizable material, alternating regions of which layer have been magnetized to provide oppositely directed magnetic fields, all such fields extending substantially perpendicular to the layer, the two jaws being positioned such that the respective layers face each other and extend parallel to the undulator axis.

26. The undulator of claim 25 wherein north and south poles of the first jaw are respectively positioned directly opposite the south and north poles of the second jaw.

27. The undulator of claim 25 wherein the layer is not continuous.

28. In an undulator for causing transverse undulations in the trajectory of a charged particle travelling along a substantially linear trajectory, at least one jaw comprising a continuous layer of a magnetizable material, the layer having two substantially continuous, parallel and planar faces, discrete regions of which layer have been permanently magnetized to provide magnetic fields that are oriented transversely to the faces.

29. An undulator for causing transverse undulations in the trajectory of a charged particle travelling along a substantially linear trajectory, at least one jaw comprising:

continuous layer of magnetizable material, the layer having two substantially continuous, parallel and planar faces and a plurality of side edges and being sufficiently thick to retain sufficient coercive force to cause particle deflection, alternating regions of the layer being permanently magnetized to provide oppositely directed magnetic fields that are oriented transversely to the faces and having aspect ratios of no more than about 1.0; and a substrate over which the layer is superposed for dimensional stability, the substrate having a smooth surface which conforms to the faces and being made of a magnetizable material that has a low magnetic remanence.

30. A method for providing an undulator to cause transverse undulations in the trajectory of a charged particle travelling along a substantially linear trajectory, the method comprising:

providing a body having at least one substantially planar layer of magnetizable material;

magnetizing regions of the layer by subjecting the layer, at periodic intervals along a line, to transverse magnetic fields, so that adjacent regions of the layer acquire a magnetization substantially aligned with each other, but a magnetization whose strength and sign can differ from region to region., positioning two of the bodies such that the respective layers extend substantially parallel to an undulator axis therebetween, which axis is positionable substantially to coincide with the trajectory of moving charged particles.

31. The method of claim 30 for providing an undulator having n periods wherein the magnetizable material is magnetized by:

a. positioning the body such that a region of the layer is aligned with a magnetic head;

b. using the head to apply a field extending through the layer in a first direction, the field being of sufficient strength to permanently magnetize the region that is aligned with the head;

c. moving the body in relation to the head so that the head is aligned with an adjacent region of the layer;

d. using the head to apply a reverse field extending through the layer in a second direction that is opposite to the first direction;

e. moving the body in relation to the head so that the head is aligned with the next adjacent region of the layer, the next adjacent region being in line with the previously recorded regions; and f. repeating steps b-e until n pairs of magnetic poles are provided in the layer.

32. The method of claim 31 wherein:

the head is an electromagnetic head; and the fields are applied by supplying current to the head.

33. The method of claim 30 wherein the body is provided by applying the magnetizable material to the surface of a substrate that has a low magnetic remanence.

34. The method of claim 33 wherein the substrate is made of a ferromagnetic material selected from the group consisting of iron and steel.

35. The method of claim 30 wherein the magnetizable material is selected from the group considting of NdFe/B and SmCo.

* * * * *